US006011427A

United States Patent [19]

Cargill

[11] Patent Number: 6,011,427

[45] Date of Patent: Jan. 4, 2000

[54] HIGH EFFICIENCY BASE CURRENT HELPER

[75] Inventor: Robert S. Cargill, Portland, Oreg.

[73] Assignee: Maxim Integrated Products, Inc., Sunnyvale, Calif.

[21] Appl. No.: 08/770,519

[22] Filed: Dec. 20, 1996

[51] Int. Cl.[7] ..... G05F 1/10

[52] U.S. Cl. ..... 327/538; 327/540; 323/316

[58] Field of Search ..... 327/538, 540, 327/545; 323/316

[56] References Cited

U.S. PATENT DOCUMENTS

| | | | |
|---|---|---|---|
| 4,350,904 | 9/1982 | Cordell . | |
| 4,675,594 | 6/1987 | Reinke | 327/542 |
| 4,700,144 | 10/1987 | Thomson . | |
| 4,763,021 | 8/1988 | Stickel | 327/541 |
| 4,952,867 | 8/1990 | Anderson et al. . | |
| 5,485,117 | 1/1996 | Furumochi | 327/538 |
| 5,493,234 | 2/1996 | Oh | 327/541 |
| 5,506,541 | 4/1996 | Herndon | 327/541 |

OTHER PUBLICATIONS

"A 2.5–V Active Low–Pass Filter Using All–n–p–n Gilbert Cells with a 1–$V_{pp}$ Linear Input Range", Koyama et al., IEEE Journal of Solid–State Circuits, vol. 28, No. 12 (Dec. 1993).

*Primary Examiner*—Terry D. Cunningham
*Attorney, Agent, or Firm*—Blakely, Sokoloff, Taylor & Zafman LLP

[57] ABSTRACT

High efficiency base current helper to improve the accuracy of current mirrors particularly useful for current mirror utilizing relatively low beta bipolar junction transistors. The high efficiency base current helper utilizes two feedback loops, the first attempting to force the bias rail voltage to a mirror reference voltage and the second sensing excess current in the first loop and forcing it to match a reference level. This causes the first loop to be biased with no more excess current than desired for any process or temperature condition yielding dramatic reductions in wasted bias current. A specific exemplary embodiment is disclosed.

20 Claims, 1 Drawing Sheet

HIGH EFFICIENCY BASE CURRENT HELPER

BACKGROUND OF THE INVENTION

1. Field of the Invention

The present invention relates to base current helpers, and more particularly to base current helpers as are used in such circuits as current mirrors to help overcome the effects of base current in a collector circuit of the mirroring device.

2. Prior Art

Current mirrors are commonly used in many circuits to provide one or more currents equal to or proportional to a reference current for biasing as well as various other purposes. A commonly used current mirror is shown in FIG. 1. The current mirror shown consists of diode connected transistor Q1, the base and collector of which are connected to the base of transistor Q2. To the extent that the transistors are high gain transistors so that base currents can be ignored and transistors Q1 and Q2 are substantially identical, the collector current in transistor Q2 will equal the collector current in transistor Q1, namely the reference current I1. In fact, however, the base current for both transistors Q1 and Q2 flows in the collector circuit of transistor Q1, so that considering base currents, the mirrored current in the collector of transistor Q2 will be equal to I1−2IB, where I1 is the reference current in the collector circuit of transistor Q1 and IB is the base current in each of transistors Q1 and Q2.

To the extent the gain of the transistors is limited, the mirrored current will be in error. For instance, a simple current mirror of this type suffers a 10% error in a 1-to-1 current mirror with betas (beta is the ratio of collector current to base current of a transistor) of 20. Also, it is frequently desired to make transistor Q2 n times as large as transistor Q1 so that for the same base-emitter voltage as transistor Q1, transistor Q2 would conduct approximately n times the reference current I1. However, with limited beta transistors, the simple current mirror will not produce ratios significantly above 1-to-1 effectively. Also, current mirrors are frequently used to mirror a reference current on a 1-to-1 or other basis to a plurality of transistors rather than the single transistor Q2 of FIG. 1, increasing the error of the current mirror because of the increased number of base current components in the collector circuit of transistor Q1.

The foregoing base current induced errors are not limited to bipolar junction transistors, but are particularly severe in the case of lateral PNP bipolar junction transistors because of the finite beta of such devices. As for many present day processes, these lateral devices have betas that may fall into the single digits. To prevent accuracy problems in current sources, base current helpers are typically employed. These buffers absorb the excess base current at the cost of biasing the additional buffer. Unfortunately, the present state of the art biases these helpers in class A, meaning that the standing current in the helpers must exceed the worst case possible demands to keep the current sources alive. This can be several times greater than the nominal required, and can require in excess of 10% of the current source value.

A typical prior art current mirror with base current helper may be seen in FIG. 2. Here, the current for the bases of transistors Q3 and Q4 is set by transistor Q5 responding to the collector voltage of transistor Q3. Thus the current in the collector of transistor Q4 is equal to I2 minus the base current of transistor Q5. Because of the isolation of the base current of transistor Q4 from the collector circuit of transistor Q3, this circuit is much more tolerant to the use of a transistor to which the current is mirrored (Q4) which is n times larger than the mirroring transistor (Q3). However, even this mirror with helper, while improved, will produce errors in excess of 5% for a 10-to-1 current ratio, assuming the same exemplary betas of 20.

FIG. 3 is a circuit diagram for another prior art base current helper. The circuit of FIG. 3 has the advantage of using NPN devices for the feedback loop. Such devices typically have significantly higher betas, and even if they didn't, their currents can be set independent of the currents in the mirror devices Q13 and Q14, reducing the error when compared to the mirror with helper of FIG. 2. Current ratios in excess of 10-to-1 are possible with the circuit of FIG. 3 at accuracies at around 1%. In this circuit, the reference current I6 is fed to the collector of transistor Q13. Transistor Q16 acts to force the collector of transistor Q13 to bias at a potential relative to the base of transistor Q13 determined by the voltage V2. Thus, the base to collector voltage of transistor Q13 is forced to a known potential difference. When this occurs, the collector current through transistor Q13 roughly matches the reference current, and with the exception of Early voltage effects, the current through the collector of transistor Q14 will equal n times the reference current I6(transistor Q14 being n times as large as transistor Q13).

The NPN base current helper of FIG. 3 may be found in a December 1993 IEEE Journal of Solid-State Circuits, Vol. 28, No. 12, pp. 1246–1253. The right half of FIG. 8 on p. 1250 of the Journal corresponds to FIG. 3 of this disclosure. This circuit is the preferred existing method for building high ratio, high accuracy PNP current mirrors in processes with lateral PNPs. V2 can be made to be any reference, but the most common practices are to replace it with NPN diodes, Schottky diodes, or a ground referenced voltage to make the voltage across current source I6 supply-voltage independent. The major disadvantage to this solution (and all other prior art the inventor has found) lies in the fact that the structure composed of Q16 and whatever implementation of voltage V2 is used must be biased by fixed current source I8. This current source must be set at a level that is determined by the absolute worst case base current of Q13 and Q14, which varies dramatically over processing and temperature for most processes. The excess current required by the circuit of FIG. 3 is primarily the collector current of transistor Q16, which is basically wasted except for the fact that it keeps transistor Q16 active. As will be seen in the detailed description of the invention herein, the present invention comprises a class of circuits that can be employed to eliminate this wasted excess current while still assuring that transistor Q16 remains active.

SUMMARY OF THE INVENTION

High efficiency base current helper to improve the accuracy of current mirrors particularly useful for current mirror utilizing relatively low beta bipolar junction transistors is disclosed. The high efficiency base current helper utilizes two feedback loops, the first attempting to force the bias rail voltage to a mirror reference voltage and the second sensing excess current in the first loop and forcing it to match a reference level. This causes the first loop to be biased with no more excess current than desired for any process or temperature condition yielding dramatic reductions in wasted bias current. A specific exemplary embodiment is disclosed.

DETAILED DESCRIPTION OF THE PRESENT INVENTION

Figure 4:
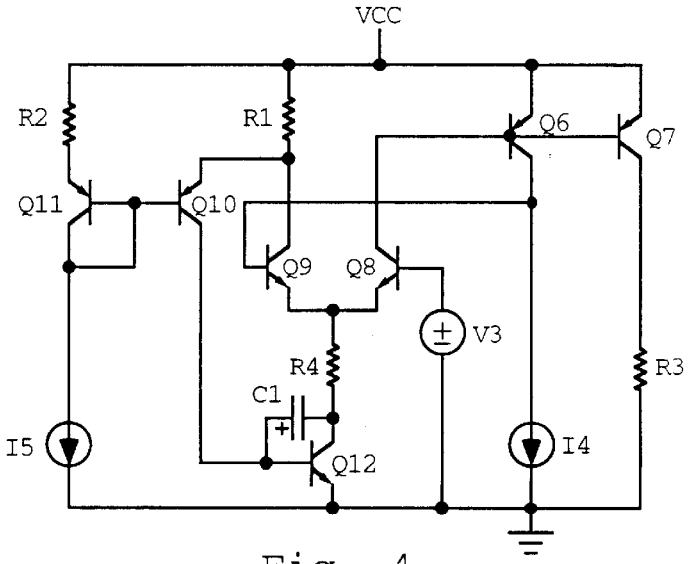
FIG. 4 is a circuit diagram which illustrates an exemplary high efficiency base current helper in accordance with the present invention.

Now referring to FIG. 4, an exemplary high efficiency base current helper in accordance with the present invention may be seen. In this circuit, transistor Q6 is the mirroring transistor, mirroring a current approximately n times the reference current I4 to transistor Q7, which is n times larger than transistor Q6. The transistor Q7 is shown operating into a load R3, though frequently the current or currents produced are used to bias or drive other transistor circuits. In that regard, the n-to-1 current ratio might alternatively represent mirroring the current in transistor Q6 to n transistors, each the same size as transistor Q6, or to some different number of transistors to provide current sources totaling n times the current in transistor Q6.

Figure 1:
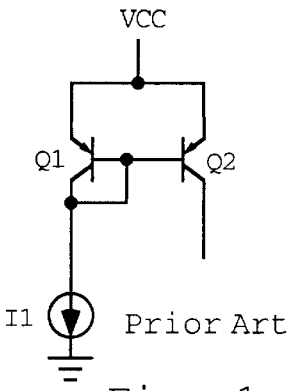
FIG. 1 is a circuit diagram illustrating a simple, commonly used current mirror.
Figure 2:
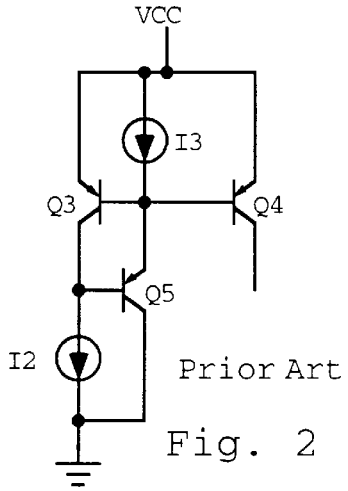
FIG. 2 is a circuit diagram for a typical prior art current mirror with base current helper.
Figure 3:
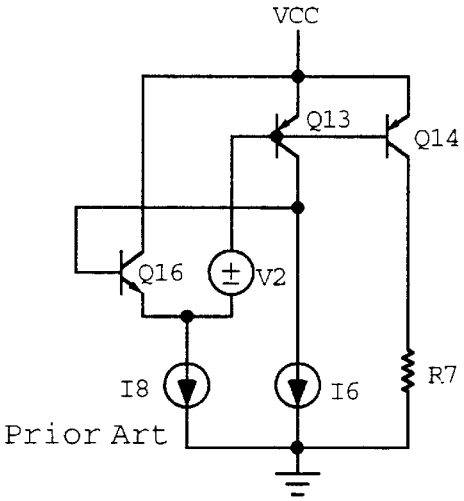
FIG. 3 is a circuit diagram for an additional prior art base current helper.

In the circuit shown in FIG. 4, transistor Q9 corresponds generally to transistor Q16 of FIG. 3, and the combination of transistor Q8 and voltage source V3 is an alternative to the voltage source V2 of FIG. 3. The voltage source V3 sets the base voltage of transistor Q8 which, because of the common emitter connection between transistors Q8 and Q9, and assuming transistor Q9 is active, sets the base voltage of transistor Q9 substantially equal to V3 also. The voltage V2 of FIG. 3 and the alternative of voltage V3 and transistor Q8 of FIG. 4 provide a level shift between the collectors of transistor Q13 and transistor Q6, respectively, and the bases of those transistors, respectively. Without this level shift, provided as shown or by some further alternate way, transistor Q13 and transistor Q6 would saturate.

The base current for the mirrored transistors Q6 and Q7 is provided by transistor Q8, resistor R4 and transistor Q12. In particular, if the collector voltage of transistor Q6 begins to rise, indicating that transistor Q6 is conducting more than the sum of the base current of transistor Q9 and reference current I4, transistor Q9 will turn on harder, raising the voltage of the emitter of transistor Q8 to turn the same off a little to decrease the base current of transistor Q6 to reduce the current flow therethrough to the desired operating point.

However, rather than to allow the current in transistor Q9 to vary as required, and particularly to be high enough to allow shifting of an adequate amount of current from transistor Q9 to transistor Q8 to provide the worst case base currents to transistors Q6 and Q7 considering the worst case process and temperature variations, the current through transistor Q9 is monitored by the voltage drop across resistor R1. This voltage drop is compared to a reference voltage drop across resistor R2, the reference voltage drop being provided as a result of the reference current I5 through diode connected transistor Q11. When the voltage drop across resistor R1 is less than the voltage drop across resistor R2, transistor Q10 will be turned on, supplying base current to transistor Q12 to turn the same on further. When the voltage drop across resistor R1 is approximately equal to the voltage drop across resistor R2, transistor Q10 will provide limited current therethrough to limit the base current to transistor Q12. The net effect is that the conductive state of transistor Q12 will be varied as required so that the current through transistor Q9 will be relatively fixed, and preferably fixed at a relatively low value, substantially equal to the reference current I5 if resistors R1 and R2 are equal. This means that the current through transistor Q12 need not always be adequate to provide the base current for transistors Q6 and Q7 under the worst temperature and process conditions, but rather that the current in transistor Q12 is made to be only that required for the present temperature and process conditions for that specific integrated circuit. This is to be compared with the reference current source I8 in FIG. 3, wherein that reference current must be set to provide the worst case base currents through transistors Q13 and Q14, even though the worst process variations are not frequently encountered and even though the circuit is not operating, or for that matter may never actually operate, at the worst case temperature specification for the part. Thus, while the circuit of FIG. 3 provides a feedback loop to control the base currents for transistors Q13 and Q14, the circuit of FIG. 4 has a second feedback loop to control the current in the first feedback loop, and more particularly to limit the current in the first feedback loop to only that required under the then present conditions to supply the required base currents through transistor Q8 plus a little more current to keep transistor Q9 active.

For current mirrors running at a few milliamps, the savings through the use of the adaptive biasing of FIG. 4 can measure in the hundreds of mircoamps when compared against the prior art. Although the second feedback loop typically requires stabilization, this is not usually a penalty when compared to the prior art. The second feedback loop is fairly easy to stabilize with the addition of resistor R4. This resistor permits the use of the Miller effect to multiply the loading of the capacitor Cl on the collector of transistor Q10. Also, it may be noted that the present invention is normally used as part of a larger integrated circuit. Therefore, it is not usually necessary to actually separately provide the reference current source I5, transistor Q11 and resistor R2 as most bias generators have a suitable supply reference voltage already available.

Another benefit of the high efficiency base current helper of the present invention is the flexibility it gives the designer in controlling turn-on transients. Through careful selection of loop components, the designer can tailor the speed of the turn-on ramp and determine whether an underdamped or overdamped response is delivered. This can benefit those who need to limit spurious transmissions emitted when their devices are first activated, or in situations where the devices are powered down between transmission slots as a matter of protocol, as in TDMA.

While the present invention is particularly beneficial in circuits using modest or low beta transistors such as lateral PNP transistors such as is typical of most high frequency RF bipolar processes in use today, most other biasing structures could also benefit by incorporation of the invention. Further, current mirrors with high mirroring ratios could also benefit from the efficiency improvements. Of course, the efficiency gains are particularly important in portable battery powered and wireless communication devices where they may reduce current consumption and extend battery life.

The embodiment of the present invention shown in FIG. 4 is shown in conjunction with the supply of base current for PNP devices Q6 and Q7. In that regard, note that the phrases "current source" and "source of current" are used herein and in the claims in a most general sense, as is common in the technology, to include both current sources and current sinks. Thus, for instance, while I4 and I5 and FIG. 4 are referred to as current sources, the same actually provide a current sinking function in the specific embodiment shown.

Similarly, it will be understood that statements such as the base currents for transistors Q6 and Q7 are supplied by transistor Q8, actually relate to the flow of current from the bases through transistor Q8 for the embodiment shown. Of course, the circuit of FIG. 4 can be reversed by changing the direction of the current sources and the conductivity types of each of the transistors and of course reversing the polarity of the applied voltage to the circuit, so as to provide base current to what now would be NPN mirror transistors corresponding to transistors Q6 and Q7.

In the foregoing description, the reference current I4 to be mirrored has been described as if the same is a fixed or predetermined current. While a constant reference current I4 represents one typical application of the present invention, it should be noted that the present invention is not limited to such applications. By way of example, current source I4 may be a trimmable source based on characteristics of other circuits, so that the actual value of the current I4 under any given condition may vary significantly from circuit to circuit. Further, the current source I4 may in fact even be variable in some applications.

Similarly, while the circuit of FIG. 4 is shown as an n-to-1 ratioing circuit, whether by a single transistor Q7 n times larger than transistor Q6, or a plurality of transistors making up the equivalent of a single transistor Q7 n times the size of transistor Q6, the effective value of n may be variable either with time or circuit to circuit. By way of example, the current I4 may be mirrored to a number of individual circuits, one or more of which may have a power down or standby mode wherein the device or devices in that circuit to which the current is mirrored may at times be inactive. By way of a further example, one or more of the transistors in a circuit to which the current I4 is mirrored may be disconnectable for circuit trimming purposes, such as during the manufacturing process.

While the present invention has been disclosed and described with respect to a preferred embodiment thereof, it will be understood by those skilled in the art that various changes in form and detail may be made therein without departing from the spirit and scope thereof.

What is claimed is:

1. A circuit for providing base current in a current mirror, comprising:

a first transistor having an emitter coupled to a first terminal, a base, and a collector coupled to a first source of current, the emitter and base of the first transistor being coupled to the emitter and the base of at least one additional transistor to which the current in the first transistor is mirrored and from which a current output is provided;

a first feedback circuit coupled to the base and the collector of the first transistor and to a second source of current, the first feedback circuit controlling the base current of the first and additional transistors, responsive to a voltage on the collector of the first transistor; and a second feedback circuit coupled to the first feedback circuit and to the second source of current, the second feedback circuit controlling the second source of current responsive to the base current of the first and additional transistors.

2. The circuit of claim 1 further comprising a first resistor coupled between the first feedback circuit and the second source of current.

3. The circuit of claim 1 wherein the first feedback circuit comprises:

a second transistor having a base coupled to a second terminal through a voltage source, a collector coupled to the base of the first transistor, and an emitter; and a third transistor having a base coupled to the collector of the first transistor, a collector coupled to the first terminal, and an emitter coupled to the emitter of the second transistor and the second source of current.

4. The circuit of claim 3 wherein said third transistor diverts a portion of the current flowing through the second source of current away from the base of the first transistor and to the third transistor responsive to the voltage on the collector of the first transistor.

5. The circuit of claim 3 wherein the first terminal is a positive power supply terminal and the second terminal is a common terminal.

6. The circuit of claim 3 wherein the second feedback circuit comprises:

a first resistor coupled between the collector of the third transistor and the first terminal;

a fourth transistor having a base, a collector coupled to the second source of current, and an emitter coupled to the collector of the third transistor; and a fifth transistor having a base coupled to the base of the fourth transistor, a collector coupled to its base and to the second terminal through a third source of current, and an emitter coupled to the first terminal through a second resistor.

7. The circuit of claim 6 wherein the second feedback circuit controls the amount of current provided by the second source of current responsive to the base current of the first transistor by controlling the current in the third transistor.

8. A circuit for providing base current in a current mirror, comprising:

first and second sources of current, the second source of current being controllable;

a first transistor having a base, a collector coupled to the first source of current, and an emitter coupled to a first terminal, the emitter and base of the first transistor being coupled to the emitter and the base of at least one additional transistor to which the current in the first transistor is mirrored and from which a current output is provided;

a second transistor having a base coupled to the collector of the first transistor, a collector coupled to the first terminal, and an emitter;

a third transistor having a base, a collector coupled to the base of the first transistor, and an emitter coupled to the emitter of the second transistor and the second source of current;

a voltage source coupled between a second terminal and the base of the third transistor; and a feedback circuit coupled to the collector of the second transistor and to the second source of current.

9. The circuit of claim 8 wherein the feedback circuit comprises a resistor coupled between the second terminal and the collector of the second transistor and a current mirror controlling the second source of current to maintain the voltage drop across the resistor equal to a predetermined voltage.

10. The circuit of claim 9 wherein the predetermined voltage is a voltage generated by a current of the current mirror passing through a second resistor.

11. The circuit of claim 9 wherein the second source of current comprises a fourth transistor having an emitter coupled to the second terminal, a base, and a collector coupled to its base through a capacitor, the current mirror controlling the base of the fourth transistor.

12. The circuit of claim 8 wherein the feedback circuit comprises:

a first resistor coupled between the first terminal and the collector of the second transistor;

a fourth transistor having a base, a collector coupled to the second source of current, and an emitter coupled to the collector of the second transistor; and a fifth transistor having a base coupled to the base of the fourth transistor, a collector coupled to its base and the second terminal through a third source of current, and an emitter coupled to the first terminal through a second resistor.

13. The circuit of claim 9 further comprising a resistor coupled between the emitters of the second and third transistors and the second source of current.

14. A current mirror for mirroring current to at least one additional transistor comprising:

a first transistor having an emitter coupled to a first terminal, a base, and a collector coupled to a first source of current, the emitter and base of the first transistor being coupled to the emitter and base of the at least one additional transistor to which the current in the first transistor is mirrored and from which a current output is provided;

a first feedback circuit coupled to the base and the collector of the first transistor and to a second source of current, the first feedback circuit controlling the base current of the first and additional transistors, responsive to the collector of the first transistor;

a second feedback circuit coupled to the first feedback circuit and to the second source of current, the second feedback circuit controlling the second source of current responsive to the base current of the first and additional transistors.

15. The current mirror of claim 14 wherein the first feedback circuit comprises:

a second transistor having a base coupled to a second terminal through a voltage source, a collector coupled to the base of the first transistor, and an emitter; and a third transistor having a base coupled to the collector of the first transistor, a collector coupled to the first terminal, and an emitter coupled to the emitter of the second transistor and the second source of current.

16. The current mirror of claim 15 wherein the second feedback circuit comprises:

a first resistor coupled between the collector of the third transistor and the first terminal;

a fourth transistor having a base, a collector coupled to the second source of current, and an emitter coupled to the collector of the third transistor; and a fifth transistor having a base coupled to the base of the fourth transistor, a collector coupled to its base and to the second terminal through a third source of current, and an emitter coupled to the first terminal through a second resistor.

17. A current mirror for mirroring current to at least one additional transistor comprising:

first and second power supply terminals;

first and second sources of current coupled to the second power supply terminal, the second source of current being controllable;

a first transistor having a base, a collector coupled to the first source of current, and an emitter coupled to the first power supply terminal, the emitter and base of the first transistor being coupled to the emitter and base of the at least one additional transistor to which the current in the first transistor is mirrored and from which a current output is provided;

a second transistor having a base coupled to the collector of the first transistor, a collector coupled to the first terminal, and an emitter;

a third transistor having a base coupled to the second power supply terminal through a voltage source, a collector coupled to the base of the first transistor, and an emitter coupled to the emitter of the second transistor and the second source of current; and a feedback circuit coupled to the collector of the second transistor and to the second source of current for controlling the second source of current to maintain a substantially constant current in the second transistor.

18. The current mirror of claim 17 wherein the feedback circuit comprises:

a first resistor coupled between the collector of the second transistor and the first power supply terminal;

fourth transistor having a base, a collector coupled to the second source of current, and an emitter coupled to the collector of the second transistor; and a fifth transistor having a base coupled to the base of the fourth transistor, a collector coupled to its base and the second power supply terminal through a third source of current, and an emitter coupled to the first power supply terminal through a second resistor.

19. The current mirror of claim 18 wherein the predetermined voltage is a voltage generated by a current of the third source of current passing through the second resistor.

20. The current mirror of claim 17 wherein the second source of current is a fourth transistor having an emitter coupled to the second power supply terminal, a base coupled to the feedback circuit, and a collector coupled to the emitters of the second and third transistors and its base, said fourth transistor being of the same conductivity type as the second transistor.

* * * * *